United States Patent [19]

Kosaka et al.

[11] Patent Number: 4,842,264

[45] Date of Patent: Jun. 27, 1989

[54] SORTING MACHINE

[75] Inventors: Kenji Kosaka, Naka; Akihiro Suzuki, Ibaraki, both of Japan

[73] Assignee: Ikegami Tsushinki Co., Ltd., Tokyo, Japan

[21] Appl. No.: 91,905

[22] Filed: Sep. 1, 1987

[30] Foreign Application Priority Data

Sep. 9, 1986 [JP] Japan ..... 61-210675
Sep. 9, 1986 [JP] Japan ..... 61-210676
Sep. 9, 1986 [JP] Japan ..... 61-137365[U]

[51] Int. Cl.[4] ..... B65H 39/10

[52] U.S. Cl. ..... 271/293; 271/176; 271/296

[58] Field of Search ..... 271/292, 293, 294, 296, 271/300, 186, 176

[56] References Cited

U.S. PATENT DOCUMENTS

| | | | |
|---|---|---|---|
| 3,372,922 | 3/1968 | Snellman | 271/296 |
| 3,414,254 | 12/1968 | Snellman | 271/296 |
| 4,322,069 | 3/1982 | Mitchell . | |
| 4,361,320 | 11/1982 | Kikuchi et al. . | |
| 4,405,225 | 9/1983 | Perrault | 271/296 X |
| 4,449,813 | 5/1984 | Kikuchi et al. . | |
| 4,498,665 | 2/1985 | Watanabe . | |
| 4,548,403 | 10/1985 | Matsui | 271/296 |
| 4,561,647 | 12/1985 | Snellman et al. . | |
| 4,576,371 | 3/1986 | Takahashi et al. | 271/296 |
| 4,580,775 | 4/1986 | Maruyama | 271/296 X |
| 4,621,803 | 11/1986 | Johdui | 271/293 |

FOREIGN PATENT DOCUMENTS

| | | |
|---|---|---|
| 56-78768 | 6/1981 | Japan . |
| 58-220053 | 12/1983 | Japan . |
| 58-220054 | 12/1983 | Japan . |
| 60-82566 | 5/1985 | Japan . |
| 61-162464 | 7/1986 | Japan . |
| 1248100 | 9/1971 | United Kingdom . |

OTHER PUBLICATIONS

Chironis, Nicholas P., "Mechanisms, Linkages, and Mechanical Controls", 1965, McGraw Hill Book Company.

*Primary Examiner*—Richard A. Schacher
*Attorney, Agent, or Firm*—Oliff & Berridge

[57] ABSTRACT

A recorded sheet is turned from a face-up condition to a face-down condition by horizontal transport belts, a first guide member, vertical transport belts, and a second guide member. The recorded sheet is guided to a discharge device, and discharged to a tray by the discharge device. During a sorting action, the discharge device is transferred by a transfer device to the tray to which a sheet is to be discharged. In response to this transfer, a hold member is extended or shortened in a vertical direction and holds a sheet being transported between the hold member and the vertical transport belts in such a manner as to avoid interference with its transport, so that the sheet can be prevented from falling by gravity.

8 Claims, 5 Drawing Sheets

SORTING MACHINE

BACKGROUND OF THE INVENTION

1. Field of the Invention

The present invention relates to a sorting machine, particularly to a sorting machine which receives recorded sheets delivered from a host sheet supplying unit, such as a copier or a printer, turns the sheets upside down, and discharges them selectively to one of a plurality of trays arranged in a vertical array, thereby permitting their distribution and reception.

2. Description of the Prior Art

A conventional sorting machine of this type is known which is so composed that a plurality of trays are vertically fixedly stacked with intervals therebetween, and recorded sheets conveyed from a feed opening by a transport mechanism are discharged to a tray selected by a tray selecting means. Alternatively, various other types of apparatus are known, including ones so designed that by an integral vertical movement of vertically spaced trays a selected tray entry is aligned with a sheet discharge portion so as to discharge sheets onto the selected tray.

In the conventional sorting machines, however, sheets delivered from a copier or the like are usually discharged to the trays in a face-up condition, i.e., with their recorded surfaces or their faces turned up. If there is a plurality of pages of manuscript, the pages will be stacked in a reverse sequence, and it takes an operator a lot of time to restack them in the right sequence. Therefore, post processing sorting machines also have been developed which have a function of turning sheets over into a face-down condition before they are discharged to trays. However, these mechanisms have tended to be too complicated.

SUMMARY OF THE INVENTION

It is an object of the present invention to provide a sorting machine which has a simplified transport mechanism, is simple in construction, and is capable of turning recorded sheets upside down and discharging them in a face-down condition to trays.

It is another object of the present invention to provide a sorting machine which can accurately detect discharge of sheets to trays.

In order to accomplish the above objects, a first aspect of the present invention comprises a plurality of trays each having a tray pin on each side of the tray's sheet entry end, horizontal transport means for transporting sheets horizontally, a first guide member which turns the horizontally transported sheets to a vertical direction, vertical transport means for transporting the turned sheets vertically, discharge means for discharging the sheets transported by the vertical transport means to one of the plurality of trays, a second guide member which guides the sheets transported by vertical transport means to the discharge means so as to face the sheets down in a horizontal direction, transfer means for transferring the discharge means and the second guide member, and hold means, which is retractile in the vertical transport direction of the sheets according to the transfer of the discharge means, for holding the sheets in position between the hold means and the vertical transport means.

In the first aspect of the present invention, the sheets transported horizontally by the horizontal transport means are turned to a vertical direction by the first guide member. The second guide member guides the sheets transported by the vertical transport mean to the discharge means while returning them to a horizontal direction so as to face downward. Thus, the sheets discharged by the discharge means are received in a face-down condition into the trays. The hold means operates in a retractile manner according to the transfer of the discharge means by the transfer means so as to hold the sheets in position, so that their dropping by gravity or jamming can be prevented during vertical transport as well.

In a second aspect of the present invention, the transfer means mentioned above comprises a tray entry forming means which forms an entry between the two adjacent trays for the sheets being discharged according to the transfer of the discharge means. In the second aspect, the tray entry forming means forms an entry for the sheets according to the transfer of the discharge means, so that it becomes possible to space the other trays closer.

A third aspect of the present invention further comprises a tiltable light-shutting member which is tilted down by the sheets being discharged by the discharge means, and an optical sensor which detects the discharge of the sheets into a tray by detecting the tilt-down of such light-shutting member. The third aspect of the present invention enables detection of the discharge of sheets since detection output of the sensor changes upon tilt-down of the light-shutting member by the sheets being discharged. Therefore, discharge of the sheets can be accurately detected even if they are transparent.

A fourth aspect of the present invention comprises feed means for feeding sheets to the horizontal transport means from a feed opening, a non-sorting tray which receives sheets fed by the feed means in a non-sorting mode, and shift means for shifting the flow so as to discharge the sheets fed by the feed means into the non-sorting tray. In the fourth aspect, the direction of transport is shifted during the non-sorting mode by the shift means so as to discharge the sheets into the non-sorting tray from the feed means, thus making it possible to receive the sheets in a face-up condition into the non-sorting tray. Therefore, an operator can receive the sheets into the sorting trays or the non-sorting tray with their face turned in a desired direction.

The above and other objects, effects, features and advantages of the present invention will become more apparent from the following description of preferred embodiments thereof taken in conjunction with the accompanying drawings.

DETAILED DESCRIPTION OF PREFERRED EMBODIMENTS

Figure 1:
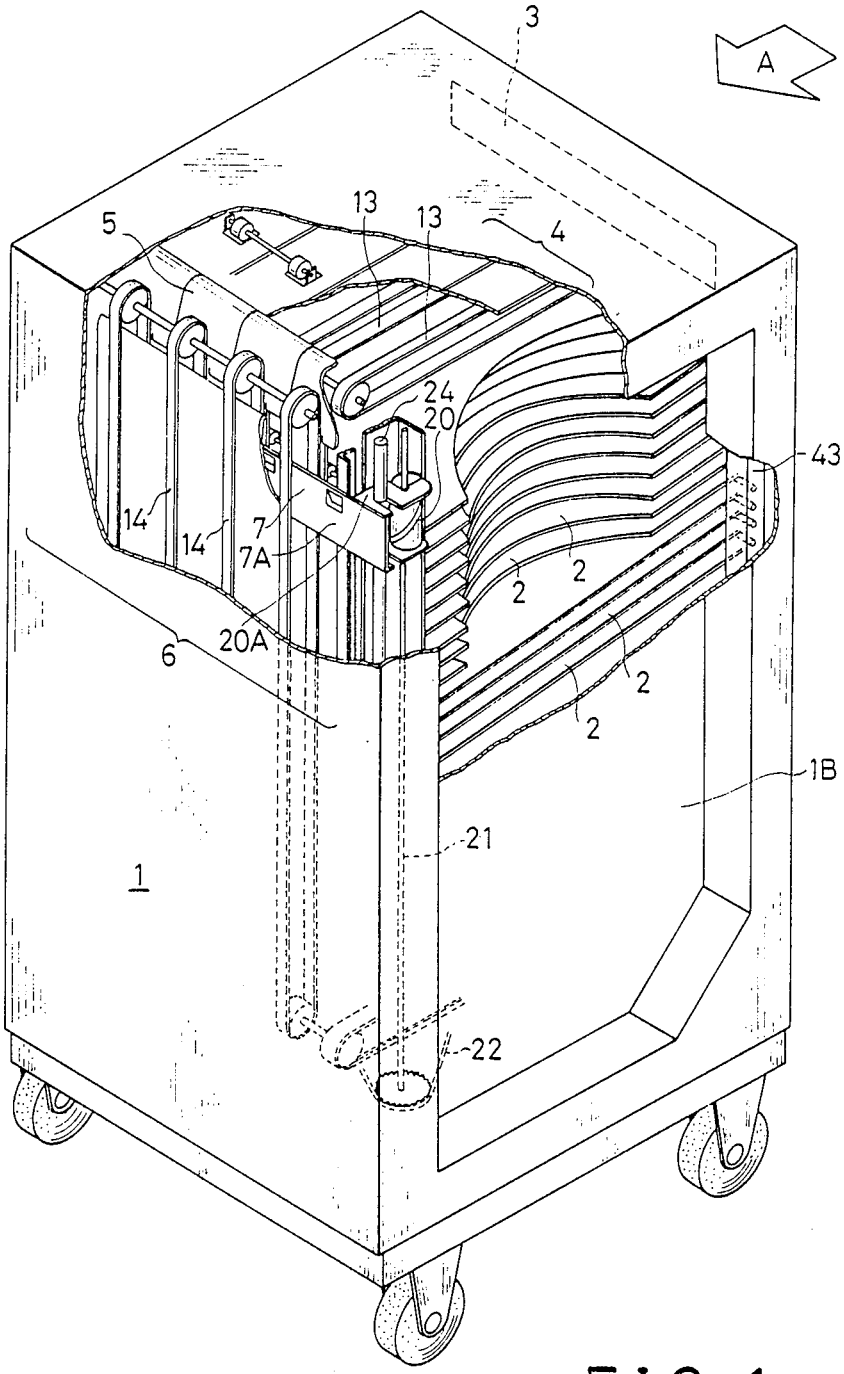
FIG. 1 is a partially cutaway perspective view of a sorting machine of the present invention.

FIG. 1 shows an embodiment of the present invention. The present sorting machine has an outer case 1 formed like a box and having an aperture 1B, as shown in FIG. 1, making it possible to remove sorted sheets from the side of a plurality of trays 2 which are disposed in a vertical stack and accessible through the aperture 1B. The sheets delivered in the arrow A direction from a host sheet supplying unit (not shown), such as a copier, are led during the sorting mode from a feed opening 3 directly to a horizontal transport portion 4, from which they are turned to a vertical, downward direction along a guide plate 5. Next, the sheets are led to a tray discharge unit 7 by a vertical transport portion 6, and further turned to horizontal to be discharged into the trays 2. An overall set up is described in detail referring to FIG. 2.

Figure 2:
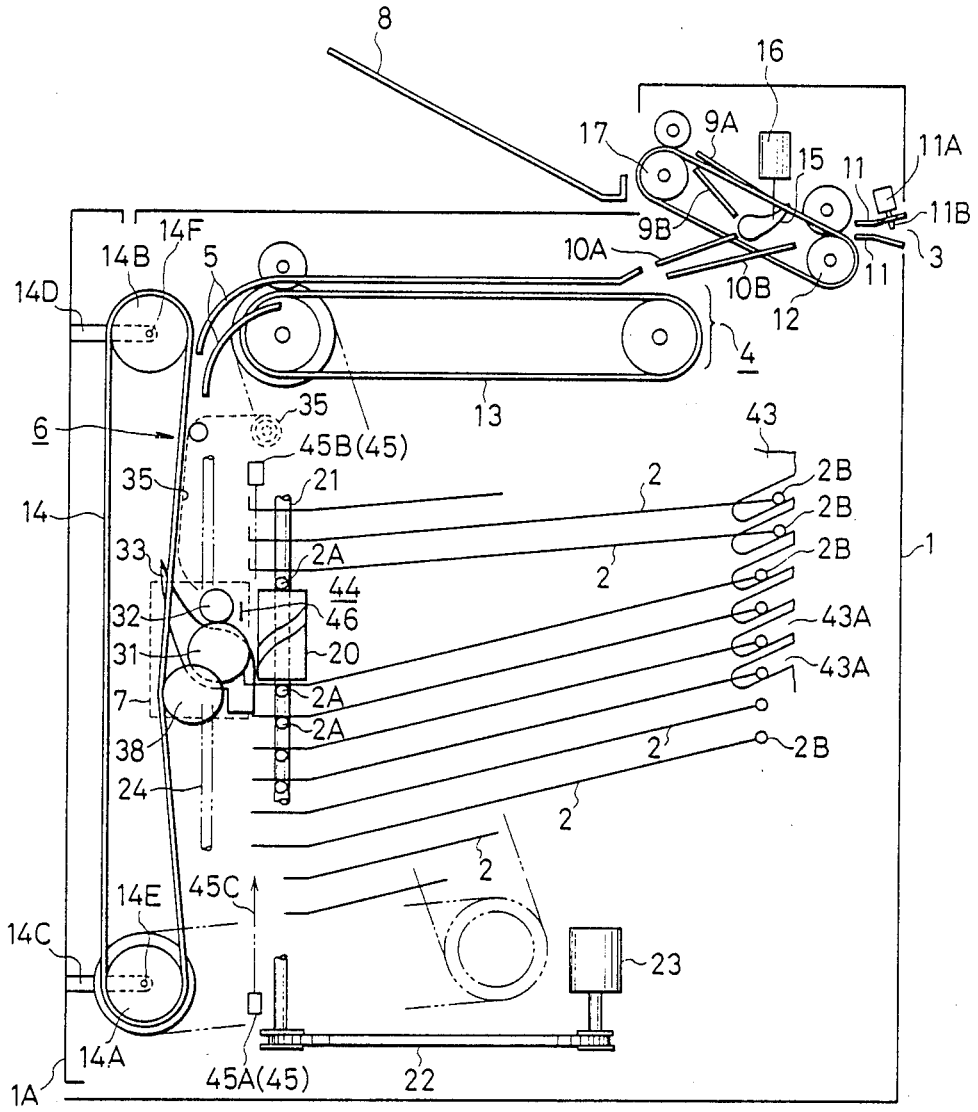
FIG. 2 is a side elevational schematic view in cross section of the sorting machine shown in FIG. 1.

FIG. 2 shows an embodiment which includes a non-sorting tray 8. Here 9A and 9B are upper and lower guide plates to be used when discharging sheets into a non-sorting tray 8, while 10A and 10B are upper and lower guide plates which guide sheets during a sorting mode from the feed opening 3 to a horizontal transport path 4. A guide path 11 which constitutes the feed opening 3 is provided with an entry sensor 11A which consists of a photointerrupter and its light path interceptor, that is a tiltable lever 11B to shut or open the light path. The entry sensor 11A, upon detecting that sheets have been introduced to the guide path 11, causes feed rollers 12, a horizontal transport belt 13, and a vertical transport belt 14 to be driven simultaneously.

Reference numeral 15 denotes a deflector plate, and reference numeral 16 a solenoid which shifts the deflector plate 15 to a different direction. During a non-sorting mode, the deflector plate 15 is shifted clockwise by the solenoid 16 from the illustrated condition for discharge of sheets through non-sorting discharge rollers 17 into the non-sorting tray 8, keeping them stacked there. The machine is so composed that during a non-sorting mode a drive system for the feed rollers 12 and the discharge rollers 17 are disengaged by means of a clutch mechanism (not shown) from a drive system for the horizontal transport belt 13 and the vertical transport belt 14, so that only the feed rollers 12 and the discharge rollers 17 are driven and power is saved.

Next, a relationship of the vertical transport portion 6 to the discharge unit 7, which discharges sheets from the vertical transport portion 6 into trays 2 and to a tray entry forming member 20 which forms and secures an entry between the trays for sheet discharge, is described with reference to FIGS. 1–4. The two ends of a support frame 7A for the discharge unit 7, and a support frame 20A for the tray entry forming member 20, are fastened together as shown in FIGS. 1 and 4. Accordingly, the discharge unit 7 moves along with tray entry forming member 20 during vertical movement thereof. That is, in FIG. 2 a rotary drive shaft 21 rotates the tray entry forming member 20 while pivotally supporting the member 20 for free vertical movement. This rotary drive shaft 21 is driven for rotation by a drive motor 23 through a sprocket and chain mechanism 22. The support frame 20A of the tray entry forming member 20 is guided slidably upwardly and downwardly by a guide shaft 24 which is rigidly secured to a frame 47.

Figure 3:
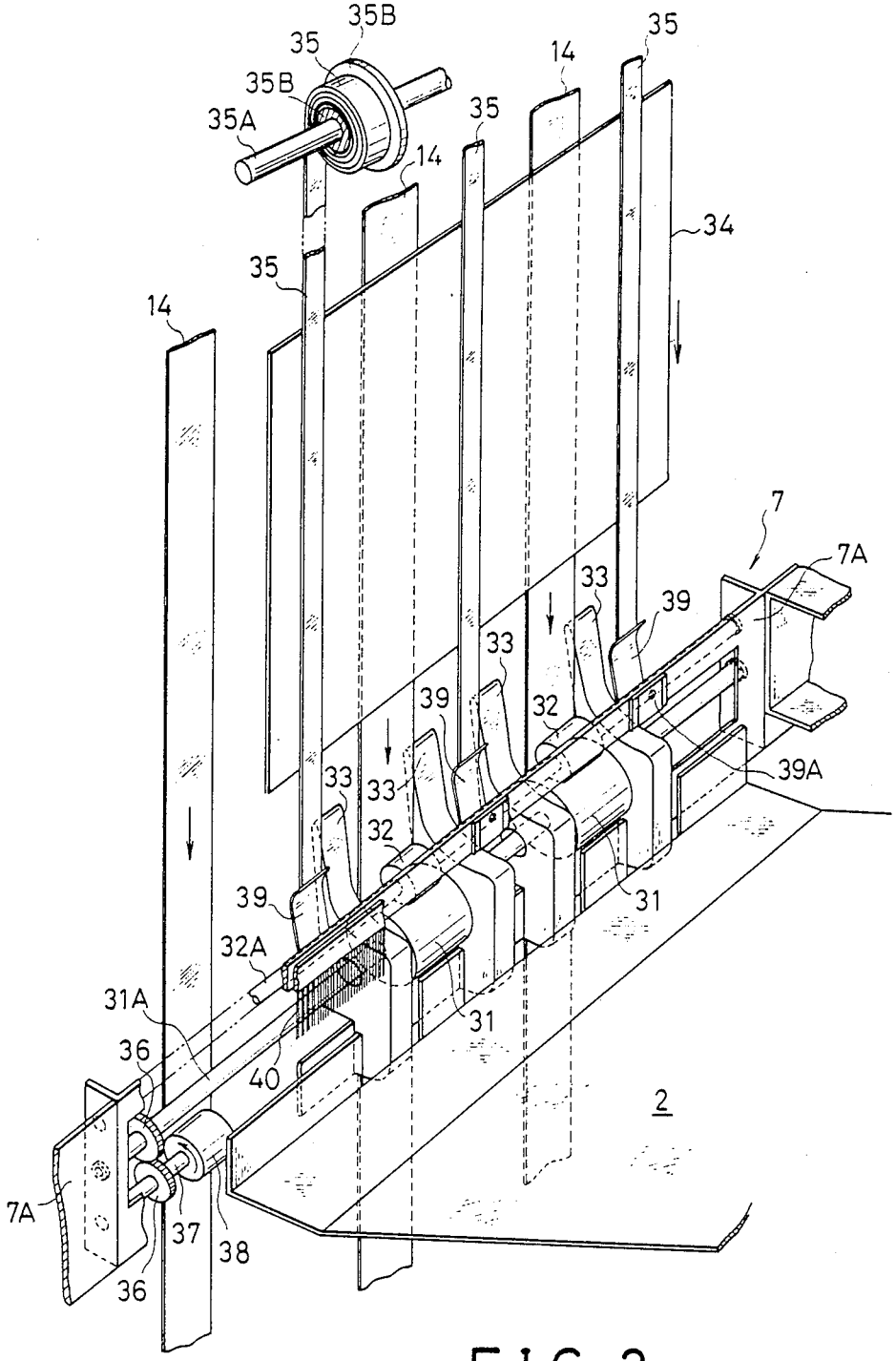
FIG. 3 is a perspective view showing an embodiment of a vertical transport portion and a discharge unit of the present invention.
Figure 4:
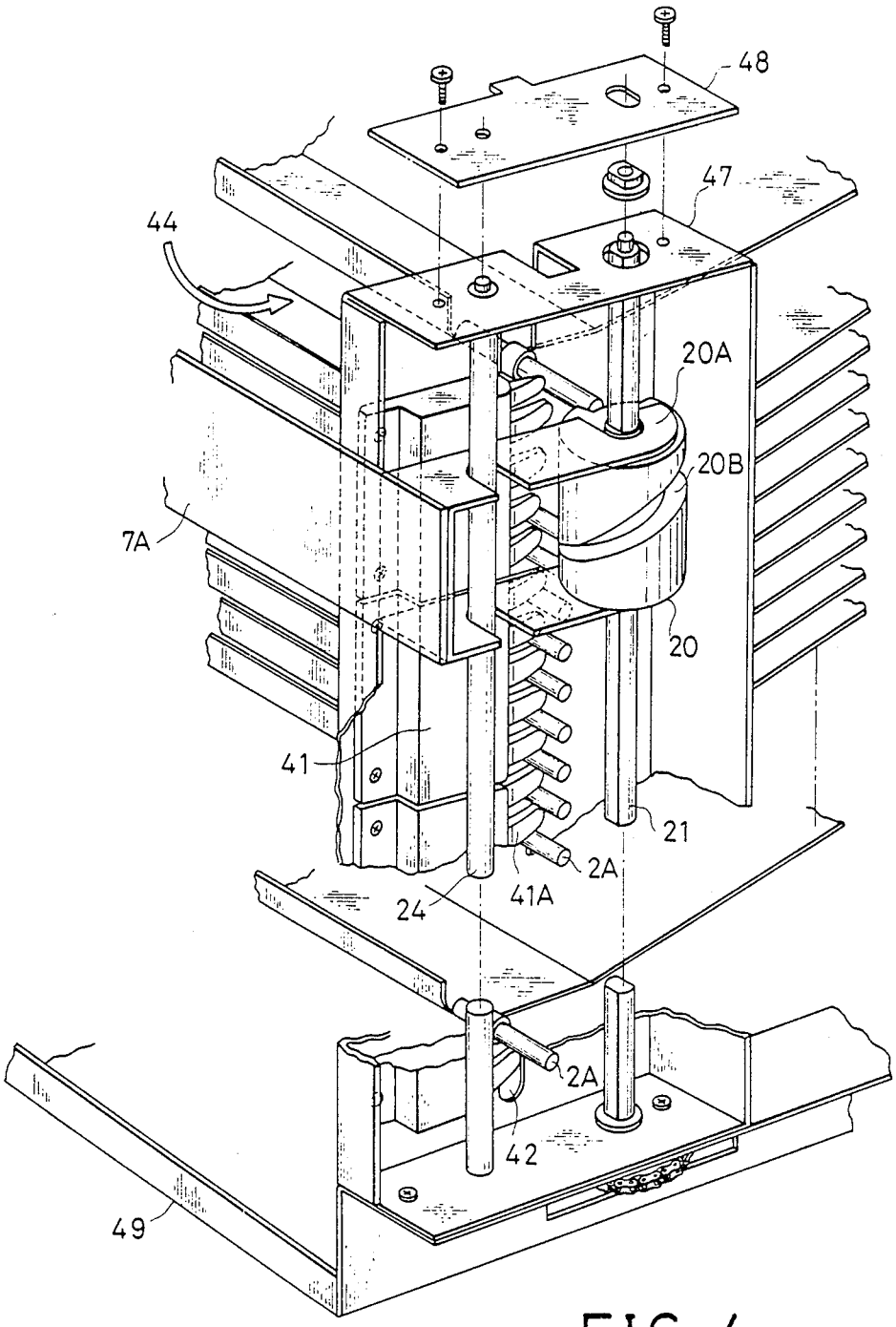
FIG. 4 is a perspective view showing an embodiment of a tray entry forming member and a tray pin support device of the present invention.

FIG. 3 further describes the relationship between the vertical transport portion 6 and the discharge unit 7. Here discharge rollers 31 are mounted on a shaft 31A supported by the two ends of the support frame 7A of the discharge unit 7. Driven or pinch rollers 32 kept in contact with the discharge rollers 31 are likewise mounted on a shaft 32A supported by the two ends of the support frame 7A. Guide claw members 33 (hereinafter called deflector members) which deflect a sheet 34 so as to guide it into a tray 2 are disposed on both sides of the discharge rollers 31. A spiral spring 35 wound around a rotatable spool 35B rotatably mounted on a shaft 35A supported by a frame is in the form of a tape measure and functions such that no matter how far it is pulled out it will attempt to rewind with constant force around the rotatable spool 35B under its own spring force. A plurality of spiral springs 35 are provided on spools 35B around the shaft 35A. The end of each spiral spring 35 is fastened to the support frame 7A. The spiral springs 35 are pulled out with vertical downward movement of the discharge unit 7, and the sheet 34 is held in place between straight surfaces of the pulled out portions of the springs and surfaces of vertical transport belts 14 which have a frictional resistance. The spiral springs 35 are made of, for example, copper base metal material, and by coming into contact with the sheet 34 remove or discharge static electricity produced on the surface of the sheet 34. Furthermore, the spiral springs 35 are so formed that, when they are extended, their cross section as cut perpendicularly to the direction of extension becomes convex with respect to the side of sheet 34 with which they come into contact, and they become vertically linear, namely, in the direction of extension as if a metal tape measure was extended.

The sheet 34, held by frictional force between spiral springs 35 and transport belts 14, is carried downward. The sheet 34 is deflected by deflector members 33, and then pinched between discharge rollers 31 and driven rollers 32, so as to be discharged toward a tray 2 past a tray entry which will be described later. Discharge rollers 31 are driven by a pulley 38, attached to a drive shaft 37, through drive gears 36 mounted respectively on discharge roller shaft 31A and drive shaft 37. Pulley 38 is driven by contact with one of the transport belts 14. Thus, jams can be prevented by rotating discharge rollers 31 at a peripheral speed slightly higher than the transport speed of the belts 14 with a proper gear ratio set up for the drive gears 36.

Reference numeral 39 denotes metal fasteners which fasten spiral springs 35 to support frame 7A by screws 39A, respectively. The spiral springs 35 are retained along the curved outer faces of the metal fasteners 39, causing the ends of the springs to be fastened to the support frame 7A. In the present embodiment, the metal fasteners 39 and the support frame 7A are taken as separate parts, but they may be integrated into a single unit. A static electricity discharge brush 40, disposed to the support frame 7A, removes or discharges static electricity from the surface of a sheet being discharged.

Next, the tray entry forming member 20 and a tray pin support structure are described in detail with reference to FIG. 4. The tray entry forming member 20, provided at each side of trays 2, and mounted on a rotary shaft 21 so as to be slidable and to transmit torque, as mentioned above, comprises a screw cam having a helical groove 20B along its column surface. Each individual tray 2 is provided with a tray pin 2A on each side of a sheet entry end of the tray, the tray pin 2A slidably engaging with a vertical guide groove 42 formed in the frame 47 in the vicinity of, and parallel to, the rotary shaft 21.

Figure 5:
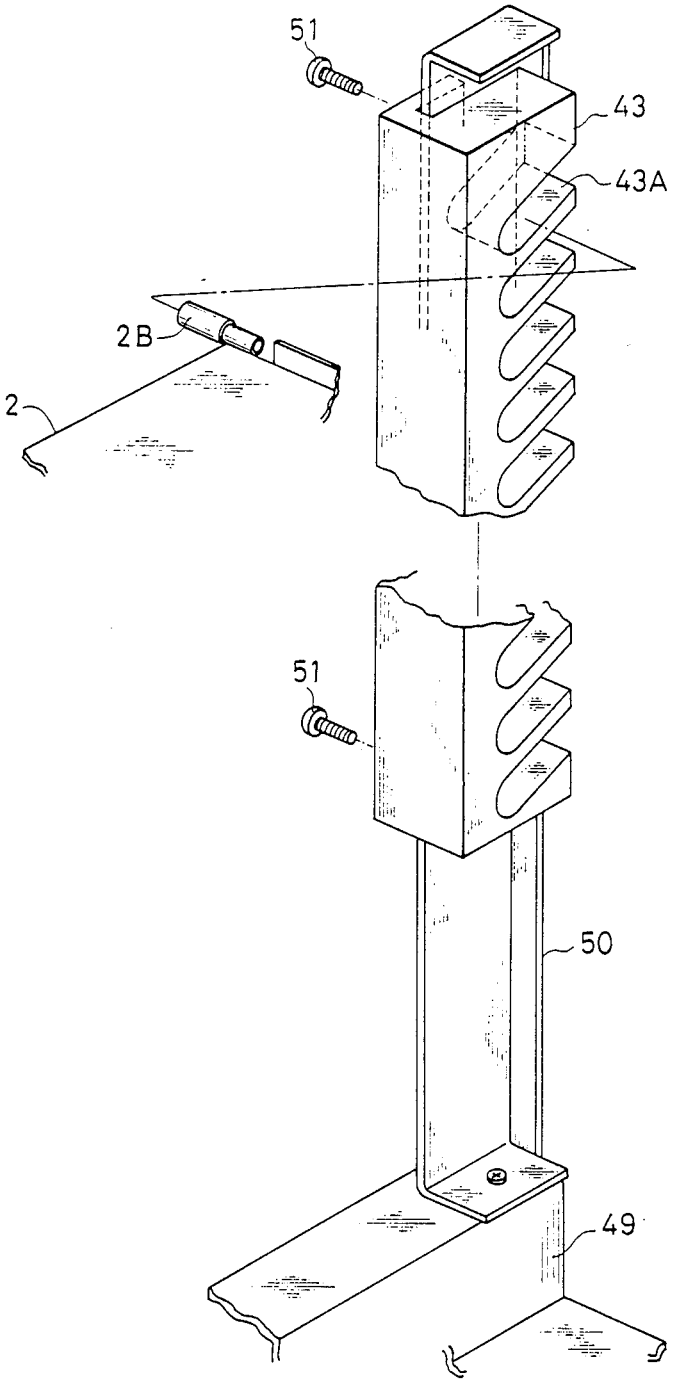
FIG. 5 is a perspective view showing an embodiment of a pin support frame of the present invention.

A support casing 41, fastened to the frame 47, has a plurality of plungers 41A vertically disposed at equal intervals. In the present embodiment, five plungers 41A are provided on one support casing 41. The tip of each plunger 41A is somewhat rounded, this portion being located on the side of the guide groove 42 formed in the frame 47. The individual tray pins 2A, on both sides of the tray 2, are supported by the plungers 41A pressed by springs and protruding from the support casing 41, respectively. When the pins 2A, through rotation of screw cam 20, subject plungers 41A to a load exceeding a specified sheet carrying load which is obtained when the tray 2 is fully loaded with the sheets discharged thereto, plungers 41A retract into the support casing 41 so that the pins 2A will be able to move. That is, rotation of screw cam 20 causes one tray pin 2A to be drawn into the helical groove 20B, so that the pin 2A can be moved upwardly or downwardly, thereby causing an axial force component of plunger 41A caused by the upward or downward movement to overcome the spring force of plunger 41A. It is desirable to make the number of plungers 41A per support casing 41, decided into the number of trays 2, a positive whole number. Each tray 2 is provided on its rear end (the end opposite to the sheet entry end) with a pair of rear end support tray pins 2B (hereinafter called rear end pins) which laterally extend from and are rigidly fixed, respectively, to opposite sides of the tray, as exemplified in FIG. 5. Each rear end pin 2B is slidably held in a slide groove 43A provided in a pin support frame 43. The slide grooves 43A are vertically spaced by an amount equal to the spacing of the trays 2. The slide grooves 43A have a steeper backward angle of inclination than do trays 2, as shown in FIG. 2. The pin support frame 43 is fastened to a support column 50 by screws 51. Furthermore, the support column 50 is secured to a base 49, as is guide shaft 24. An upper tray is raised by the screw cam 20 by means of the entry tray pin 2A, and a tray entry 44 is widely formed between the upper tray 2 above screw cam 20 and lower tray 2 below screw cam 20, whereupon the rear end of the upper tray 2 is somewhat moved up with the tray pin 2B being guided along the slide groove 43A. This operation facilitates discharging the sheets into the trays 2 without sticking or jamming even when a large stack of sheets is received in each tray 2.

The foregoing description has been provided with respect to the mechanism disposed on one side of the trays 2. A second mechanism, which is substantially identical to the one described above, comprising a second screw cam having a second helical groove, a second rotary drive shaft, a second support frame, a second guide shaft, a second set of support casings each having a plurality of plungers, and a second pin support frame, etc., is also disposed on the opposite side of the trays 2.

Furthermore, in FIG. 2 reference numerals 45A and 45B denote a light-emitter and a light-receiver of a sheet discharge detecting sensor 45 provided on the side of the tray entry 44 of the discharge unit 7, and 45C denotes a light path. Discharge unit 7 is provided on its discharge side with a tiltable light-shutting plate 46. By this plate being tilted from an upright position, when the sheets are pinched between discharge rollers 31 and driven rollers 32 and discharged in succession almost horizontally, the light path 45C is intercepted to detect the fact that the sheets are being discharged. That is, provision of the shutting plate 46 permits detection even when the sheets are light-passing transparent film, etc. In addition, if the light remains intercepted even after the time the sheets take to pass the detecting position, namely, the time from light interception by sensor 45 to reception once again has exceeded the sufficient time set for the sheets to pass the position, then it is judged through a controller (not shown) that a sheet jamming has occurred.

A description is now given of how the sorting machine thus composed operates during sorting. During the sorting mode of operation the sheet guided from the host apparatus (not shown) is sensed by the entry sensor 11A, whereupon the feed rollers 12, horizontal transport belts 13, and vertical transport belts 14 are driven by an unillustrated motor through a drive mechanism (not shown). At this time, with the deflector plate 15 held in the position shown in FIG. 2 by the solenoid 16, the sheet is guided to a position between guide plates 10A and 10B.

Thus, the sheet is guided by the horizontal transport belts 13 and the deflector guide plates 5 to a position between the vertical transport belts 14 and the spiral springs 35. Next, the sheet, while sliding along an extended straight surface of the springs 35, is held by the frictional force between the belts 14 and the springs 35, and is guided to the discharge unit 7. Thereafter, the sheet is deflected by the deflector members 33 and discharged onto a tray 2 by the discharge rollers 31 and the driven rollers 32. This discharge action is monitored by the sensor 45, while the sheet is cleared of electricity by the static electricity discharging brush 40 as shown in FIG. 3.

Upon detection by the sensor 45 of the fact that the sheet has been discharged onto the tray 2, the drive motor 23 rotates, through the sprocket and chain mechanism 22, the rotary shaft 21 on which the screw cam 20 is mounted. In the present embodiment, one revolution of the screw cam 20 in either direction lowers or raises the tray pin 2A held in contact with either the top o bottom of the screw cam 20, thus forming a next tray entry 44 on the tray one stage above or below to provide for the next discharge action.

The vertical transport belts 14 are stretched on belt pulleys 14A and 14B pivotably mounted on shafts 14E and 14F supported by support units 14C and 14D both secured to an inner frame (not shown) of a case back cover 1A. The shaft 14E of the pulley 14A is supported by the body frame, composed in such a manner that the case back cover 1A can move rotatingly around shaft 14E. Therefore, should a jam occur near the discharge unit 7, the sheet which has jammed can be removed by opening the case back cover 1A with the shaft 14E as center.

In the embodiment described above, reference has been made to the case where a screw cam is used for the tray entry forming member 20, but the invention is not so limited. For example, a similar effect is obtainable by adoption of a Geneva cam type tray entry forming member, mounted on a vertically movable horizontal shaft, whose rotation causes vertical movement of the tray pins.

Furthermore, while the above description has discussed an example where the entry side of individual trays disposed in a stack is retained vertically flexible by a tray entry forming member through tray pins and the entry between the trays is vertically shiftable, the present invention is equally applicable to a sorting machine composed in such a manner that individual trays are vertically disposed and fixed at specified intervals, a discharge unit is intermittently driven upwardly and downwardly by, for example, a combination mechanism of Geneva cam and Geneva wheel, and a recorded sheet is discharged onto a tray when the discharge unit has stopped.

What is claimed is:

1. A sorting machine comprising:

a plurality of trays vertically stacked for receiving recorded sheets, each tray having a tray pin on each side of the tray's sheet entry end;

horizontal transport means for transporting the recorded sheets horizontally;

first guide means for deflecting said horizontally transported sheets to a vertical direction;

vertical transport means for transporting said deflected sheets vertically;

discharge means for discharging into one of said plurality of trays the recorded sheets transported by said vertical transport means;

second guide means for guiding the sheets transported by said vertical transport means to said discharge means and deflecting the sheets back to a horizontal direction in a face-down condition;

transfer means for transferring said discharge means and said second guide means, said transfer means comprising entry forming means for forming an entry for a tray to which recorded sheets are to be discharged according to the transfer of said discharge means;

hold means, being retractile in the vertical transport direction of said sheets according to the movement of said discharge means, for holding said recorded sheets between said hold means and said vertical transport means; and tray support means, having plungers which are retracted by said tray pins of said trays when said entry forming means has formed an entry, for allowing vertical movement of said trays and for supporting said tray pins when said trays are at rest.

2. A sorting machine as claimed in claim 1, wherein said hold means comprises at least one spiral spring of elastic strip material which has one end held wound around a rotatable member and the other end fastened to said discharge means.

3. A sorting machine as claimed in claim 1, wherein said horizontal transport means and said vertical transport means comprise transport belts which transport said recorded sheets by means of friction.

4. A sorting machine as claimed in claim 1, wherein said transfer means comprises second hold means for holding said discharge means and said second guide means, a first guide shaft which guides said second hold means slidably upwardly and downwardly, tray entry forming means for guiding said tray pins into said groove which is fastened to said second hold means, and having a helical groove, and, and a second guide shaft which permits vertical sliding of said tray entry forming means and said second hold means and transfers said tray entry forming means upwardly and downwardly by rotating said tray entry forming means.

5. A sorting machine comprising:

a plurality of trays vertically stacked for receiving recorded sheets, each tray having a tray pin on each side of at least the tray's sheet entry end;

horizontal transport means for transporting the recorded sheets horizontally;

first guide means for deflecting said horizontally transported sheets to a vertical direction;

vertical transport means for transporting said deflected sheets vertically;

discharge means for discharging into one of said plurality of trays the recorded sheets transported by said vertical transport means;

second guide means for guiding the sheets transported by said vertical transport means to said discharge means and deflecting the sheets back to a horizontal direction in a face-down condition;

transfer means for transferring said discharge means and said second guide member;

hold means, being retractile in the vertical transport direction of said sheets according to the movement of said discharge means, for holding said recorded sheets between said hold means and said vertical transport means;

a light-shutting member which is tilted down by the recorded sheets discharged by said discharge means; and an optical sensor which detects the discharge of said recorded sheets to a tray by detecting the tilt-down of said light-shutting member.

6. A sorting machine as claimed in claim 5, wherein said hold means comprises at least one spiral spring of elastic strip material which has one end held wound around a rotatable member and the other end fastened to said discharge means.

7. A sorting machine as claimed in claim 5, wherein said horizontal transport means and said vertical transport means comprise transport belts which transport said recorded sheets by means of friction.

8. A sorting machine as claimed in claim 5, wherein said transfer means comprises second hold means for holding said discharge means and said second guide means, a first guide shaft which guides said second hold means slidably upwardly and downwardly, tray entry forming means for guiding said tray pins into said groove which is fastened to said second hold means, and having a helical groove, and, and a second guide shaft which permits vertical sliding of said tray entry forming means and said second hold means and transfers said tray enter forming means upwardly and downwardly by rotating said tray entry forming means.

* * * * *